US005598613A

United States Patent [19]

Feile et al.

[11] Patent Number: 5,598,613

[45] Date of Patent: Feb. 4, 1997

[54] LATCH MECHANISM FOR A SEAT BELT BUCKLE

[75] Inventors: Herbert Feile, Schwäbisch Gmünd; Siegfried Bareiss, Alfdorf; Claus Fauser, Böbingen; Albrecht Schock, Birkenlohe, all of Germany

[73] Assignee: TRW Repa GmbH, Alfdorf, Germany

[21] Appl. No.: 518,248

[22] Filed: Aug. 23, 1995

[30] Foreign Application Priority Data

Aug. 30, 1994 [DE] Germany ..... 9414029 U

[51] Int. Cl.[6] ..... A44B 11/28

[52] U.S. Cl. ..... 24/641; 24/633; 24/634; 24/637; 24/635

[58] Field of Search ..... 24/633, 634, 637, 24/635, 641

[56] References Cited

U.S. PATENT DOCUMENTS

| | | | |
|---|---|---|---|
| 4,394,792 | 7/1983 | Schmidt | 24/637 |
| 4,404,715 | 9/1983 | Sugimoto | 24/633 |
| 4,527,317 | 7/1985 | Straszewski et al. | 24/637 X |
| 5,008,989 | 4/1991 | Wedler et al. | 24/633 X |
| 5,014,401 | 5/1991 | Kitazawa | 24/633 |
| 5,067,211 | 11/1991 | van Riesen | 24/633 X |
| 5,357,658 | 10/1994 | Tanaka | 24/633 X |
| 5,438,492 | 8/1995 | Collins et al. | 24/633 X |

*Primary Examiner*—Peter M. Cuomo
*Assistant Examiner*—Stephen Vu
*Attorney, Agent, or Firm*—Tarolli, Sundheim, Covell, Tummino & Szabo

[57] ABSTRACT

A seat belt buckle for cooperation with an insert tongue comprises a swivel latch mounted in a frame to be movable between a locked position and a released position, and a helical pressure spring which has a first end supported by said swivel latch and a second end supported by a locking member. The spring is held by a spring receptacle which is defined by two ridges on said frame and which surrounds a spigot on said locking member. The second pressure spring end and said spring receptacle are configured such that said second spring end is self-centered on said spigot. Due to this configuration, a malassembly of the spring is excluded.

5 Claims, 4 Drawing Sheets

LATCH MECHANISM FOR A SEAT BELT BUCKLE

BACKGROUND OF THE INVENTION

The present invention relates to a seat belt buckle. More particularly, the invention relates to a seat belt buckle with a swivel latch mounted in a load bearing frame and which engages in its locked position a latching edge of an insert tongue. In a buckle of this type a locking member is shiftably mounted on the frame transversely to the swivel direction of the swivel latch between an opening position, in which it releases the swivel latch, and a locking position in which it blocks the swivel latch in its engaging position. A release button is also mounted on the frame. By actuation of the release button the locking member is shifted to the opening position. A helical pressure spring has one end supported by the swivel latch and another end supported by the locking member. The spring is held by a spring receptacle which is defined by two ridges of the frame and which surrounds a spigot on the locking member.

Buckles of this kind for seat belts have already been in use for many years due to their rugged and simple mechanical arrangement, their high reliability and low actuating forces required even when under load.

In the more or less fully automated assembly of this buckle malassembly may result by the pressure spring inserted between the swivel latch and the locking member being installed so that although being supported by the locking member it fails to register fully home as required in its receptacle. This malassembly results in a spring force deviating only slightly from the prescribed value and may thus remain unnoticed.

SUMMARY OF THE INVENTION

A seat belt buckle for cooperation with an insert tongue comprises a swivel latch mounted in a frame to be movable between a locked position and a released position, and a helical pressure spring which has a first end supported by the swivel latch and a second end supported by a locking member. The spring is held by a spring receptacle which is defined by two ridges on the frame and which surrounds a spigot on the locking member. The second pressure spring end and the spring receptacle are configured such that the second spring end is self-centered on the spigot. Due to this configuration, a malassembly of the spring is excluded.

BRIEF DESCRIPTION OF THE DRAWINGS

A preferred embodiment of the invention will now be evident from the following description and the enclosed drawings in which.

DESCRIPTION OF THE PREFERRED EMBODIMENT

Figure 1:
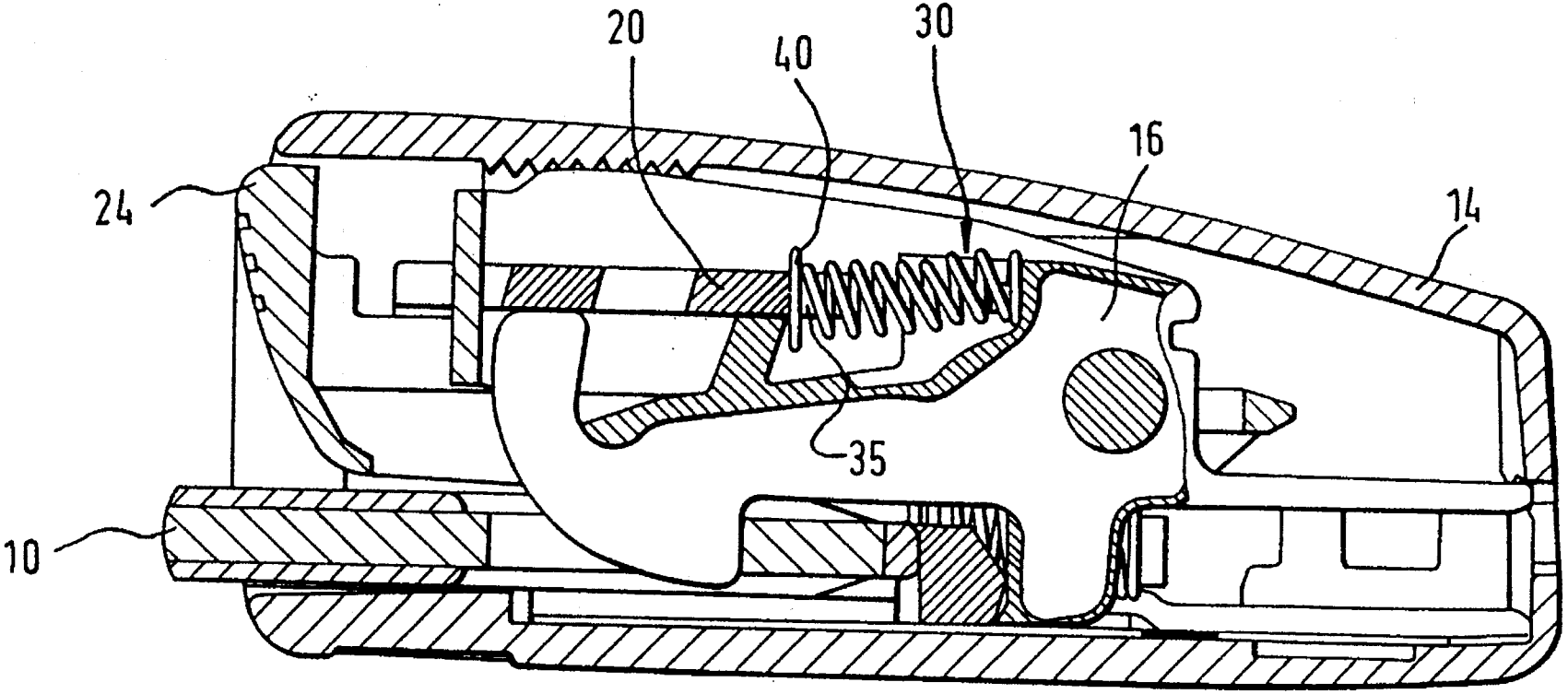
FIG. 1 is a cross-section through a buckle according to the invention.
Figure 2:
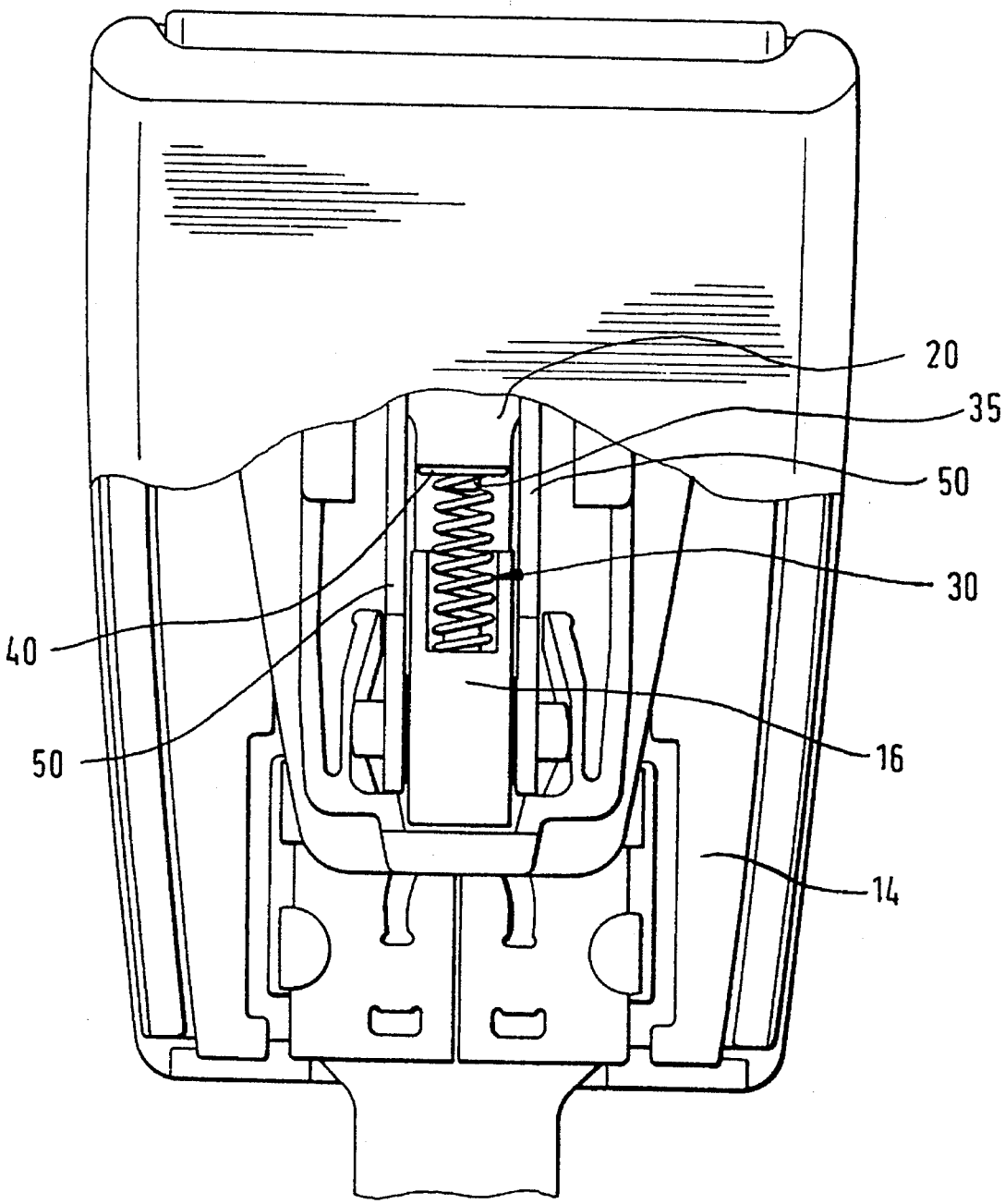
FIG. 2 is a view showing the buckle according to the invention partly opened.

In FIGS. 1 and 2 a seat belt buckle is shown in which in a load-bearing frame 14 a swivel latch 16 is mounted, which in its locking position engages a latching edge of an insertion tongue 10. In the frame 14 a locking member 20 is shiftably mounted transversely to the swivel direction of the swivel lock 16 between an opening position, in which it releases the swivel latch, and a locking position in which it blocks the swivel latch in its engaging position. In the frame 14 a release button 24 is also mounted, by actuation of which the locking member 20 is shiftable into the opening position. A helical pressure spring 30 is supported at its one end by the swivel latch 16 and its other end 40 is supported by the locking member 20, and is held by a spring receptacle which is defined by two ridges 50 of the frame 14 and surrounds a spigot 35 on the locking member 20. The pressure spring 30 loads both the swivel latch 16 in its open position and the locking member 20 in its locking position.

Figure 3:
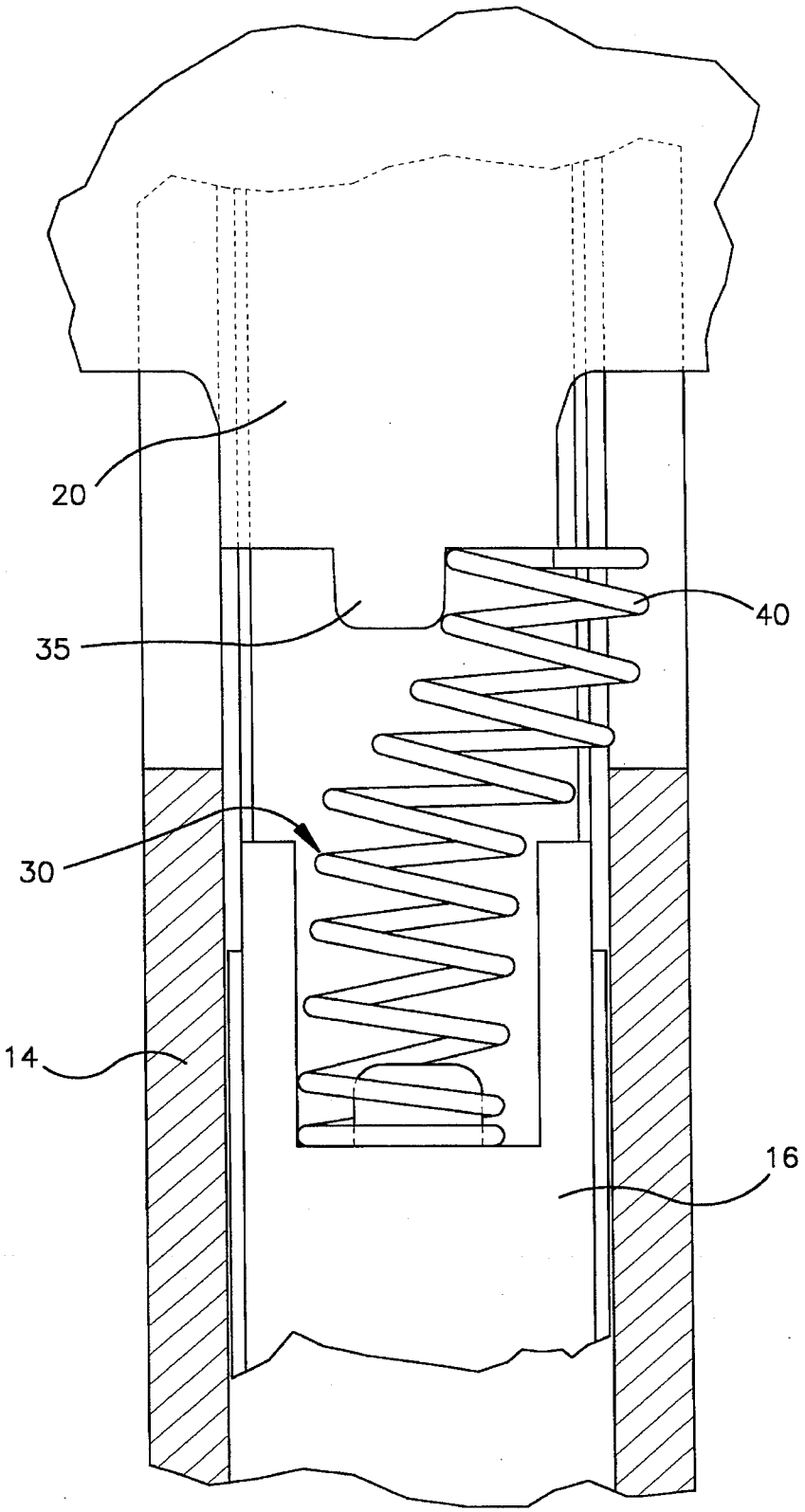
Fig.3 (PRIOR ART)
FIG. 3 is a view showing a part of buckle according to prior art, having a malassembled spring.

As can best be seen from FIG. 3, illustrating a prior art buckle in the field concerned, the receptacle for the pressure spring 30 has at the locking member 20 a spigot 35 for centering the pressure spring 30. In this configuration of the components of the buckle, as shown in the Fig., the pressure spring 30 may be malassembled so that it fails to be centered by the spigot 35, it then being supported by a section of the side of the locking member 20 facing the pressure spring located alongside the spigot 35. Malassembly of this kind is obviously undesirable in the fabrication of buckles, since it may result in the actual spring force deviating from the prescribed value.

To now prevent a malassembly of the aforementioned kind, the invention provides for the locking member end of the pressure spring and the spring receptacle being configured in such a way that the locking member end of the spring is automatically centered on the spigot.

Figure 4:
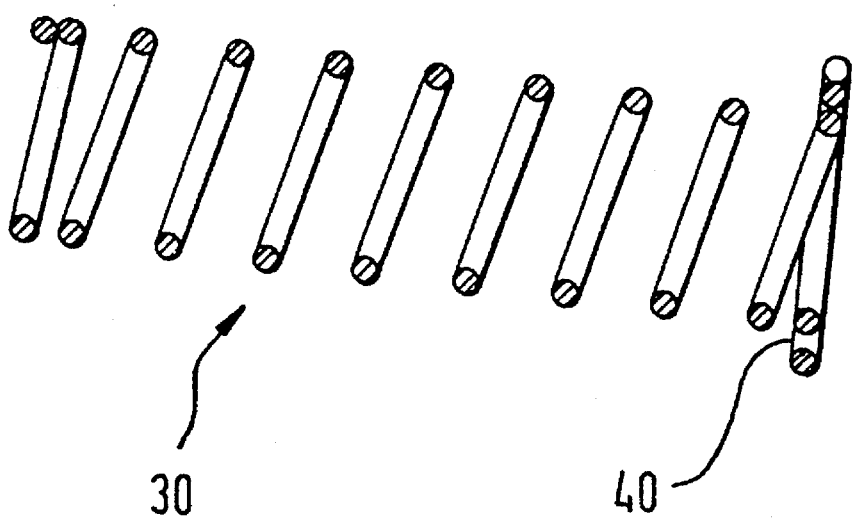
FIG. 4 is a cross-section through a spring according to one embodiment of the invention.

In the preferred embodiment of the invention illustrated in the FIGS. 1, 2 and 4 the locking member end 40 of the pressure spring 30 is formed flange-like with a larger diameter than its working windings. This larger diameter of the spring end 40 is formed by at least one further winding having a diameter larger than that of the working windings of the pressure spring 30 as a kind of guide winding which, as is best seen from FIG. 4, is formed following the winding concluding the working windings receiving attendant pressure in the plane of this winding. This spirally-shaped winding of larger diameter is designed with courses located more or less on each other up to such an outer diameter of the spring end 40 that in coaction with the ridges 50 of the frame 14 automatic centering of the spring end 40 in the spring receptacle occurs. This automatic centering prevents the malassembly of the spring end 40 in the spring receptacle shown in FIG. 3.

Having described the invention, the following is claimed:

1. A seat belt buckle for cooperation with an insert tongue, comprising a frame, a swivel latch mounted in said frame to be movable between a locked position and a released position for engagement with the insert tongue in the locked position, a locking member which is shiftably mounted on said frame transversely to a swivel direction of said swivel latch between an opening position, in which it releases said swivel latch, and a locking position in which it blocks said swivel latch in its locked position, a release button also mounted on said frame, by actuation of which said locking member is shiftable into an opening position, and a helical pressure spring which has a first end supported by said swivel latch and a second end supported by said locking member, said spring being held by a spring receptacle which is defined by two ridges on said frame and which surrounds a spigot on said locking member, said second pressure spring end and said spring receptacle being configured such that said second spring end is self-centered on said spigot.

2. The buckle as set forth in claim 1, wherein said second end of said spring is formed with an increased diameter.

3. The buckle as set forth in claim 2, wherein said second end of said spring is formed with spirally shaped adjacent windings extending in a radial plane.

4. The buckle as set forth in claim 2, wherein said second end of said spring is formed in a shape of a ring flange.

5. A seat belt buckle for cooperation with an insert tongue, comprising:

a frame;

a swivel latch for engagement with the insert tongue and which is mounted in said frame to be movable in a swivel direction between a locked position and a released position;

a locking member shiftably mounted on said frame transversely to said swivel direction of said swivel latch between an opening position, in which said swivel latch is released and a locking position in which said swivel latch is blocked in said locked position;

a release button mounted on said frame which is movable to shift said locking member from said locking position into said opening position;

a helical pressure spring which has a first end supported by said swivel latch and a second end supported by said locking member, said second end of said spring surrounding a spigot on said locking member; and a spring receptacle holding said first end of said spring, said spring receptacle being defined by two ridges on said frame;

said second end of said spring and said two ridges of said spring receptacle cooperating to self-center said second end of said spring on said spigot.

* * * * *